US006988468B2

(12) United States Patent
Higgins et al.

(10) Patent No.: US 6,988,468 B2
(45) Date of Patent: Jan. 24, 2006

(54) AUTOMATIC COMBUSTION AIR PORT CLEANER WITH AIR/OIL INDEXING MECHANISM

(75) Inventors: Dan Higgins, Tigard, OR (US); Ken Pingle, Hillsboro, OR (US); Todd Hill, Beaverton, OR (US); Mike Kranda, Portland, OR (US); Jim Payne, Portland, OR (US); Alan Clother, Portland, OR (US)

(73) Assignee: Clyde Bergemann, Inc., Beaverton, OR (US)

( * ) Notice: Subject to any disclaimer, the term of this patent is extended or adjusted under 35 U.S.C. 154(b) by 0 days.

(21) Appl. No.: 10/867,377

(22) Filed: Jun. 14, 2004

(65) Prior Publication Data

US 2005/0039705 A1 Feb. 24, 2005

Related U.S. Application Data

(60) Provisional application No. 60/478,314, filed on Jun. 12, 2003.

(51) Int. Cl.
*F22B 37/48* (2006.01)

(52) U.S. Cl. ..... 122/387; 15/104.05; 15/104.16

(58) Field of Classification Search ..... 122/387, 122/1 A, 379; 15/104.16, 104.05, 104.07; 110/182.5
See application file for complete search history.

(56) References Cited

U.S. PATENT DOCUMENTS

| | | | | |
|---|---|---|---|---|
| 5,167,192 | A * | 12/1992 | Pingel et al. | 110/182.5 |
| 5,351,631 | A * | 10/1994 | Hill et al. | 110/182.5 |
| 5,414,887 | A * | 5/1995 | Abel et al. | 15/104.16 |
| 6,672,227 | B2 * | 1/2004 | Nordenberg | 110/182.5 |

* cited by examiner

*Primary Examiner*—Gregory Wilson
(74) *Attorney, Agent, or Firm*—Dellett & Walters

(57) ABSTRACT

An indexing style Automatic Port Cleaner for cleaning furnace combustion air ports employs multiple cleaning tips and rods enclosed substantially in a furnace windbox. An extension bar enclosed substantially in a furnace windbox to which the cleaning rods are attached with the extension bar carries the cleaning rods and tips in a translating and indexing motion. An extension bar is supported by two fulcrum rods and in turn supported by two fulcrum tubes and two fulcrum housings, the fulcrum housings being supported by a faceplate and fixed relative to the combustion air ports. The fulcrum rods translate relative to the fulcrum tubes while the fulcrum tubes rotate relative to the fulcrum housings. A linear actuator is disposed to create a reciprocating translating motion of the fulcrum rods, extension bar, cleaning rods, and cleaning tips. Indexing creates rotation of the fulcrum tubes, fulcrum rods, extension bar, cleaning rods, and cleaning tips, in a reciprocating fashion about the fulcrum housings.

38 Claims, 4 Drawing Sheets

AUTOMATIC COMBUSTION AIR PORT CLEANER WITH AIR/OIL INDEXING MECHANISM

This application claims benefit of U.S. Provisional Application Ser. No. 60/478,314 filed Jun. 12, 2003.

BACKGROUND OF THE INVENTION

Automatic cleaning of combustion air ports in chemical recovery boilers is well established since Anthony-Ross Company pioneered the industry in the early 1980s. Refer to U.S. Pat. Nos. 4,423,533 and 4,822,428, held by Anthony-Ross Company. The disclosures of these patents are incorporated herein by reference. Since the introduction of these mechanisms in the 1980s, the worldwide pulp and paper industry has adopted automatic port cleaning in large scale and Anthony-Ross Company enjoys over 70% market share. During the intervening period, Anthony-Ross Company has worked continuously to refine and perfect the "index cleaning" mechanism first described in U.S. Pat. No. 4,822,428. This method of automatic port cleaning has proven to be very effective and robust and the current refined mechanism contains essentially all of the elements of the original "indexing APC". The current mechanism contains a single linear actuator (typically a pneumatic cylinder) that drives multiple cleaning rods (up to eight rods), each rod fitted with a cleaning tip, and each cleaning a single port. Therefore there is a cleaning rod and tip for every port on the boiler. Typically there may be upwards of one hundred primary air ports on a recovery boiler. In the current embodiment, each rod/tip is positioned in front of a corresponding air port, and each rod extends out of the windbox where it engages the automatic port cleaner (APC) mechanism. This arrangement has several advantages: Each rod has its own support bearings therefore the bearing loads are reduced; each rod can be adjusted relative to the port opening from outside the furnace; in the event a tip becomes stuck in the port opening, the individual rod can be loosened from the mechanism simplifying the retrieval process; there is very little obstruction of the ports inside the windbox; and the number of expensive actuators is reduced. All of these features have proven advantageous by the reliability and effectiveness of the mechanism. While the worldwide market overwhelmingly considers the Anthony-Ross APC as the "gold standard", there is still room for improvement.

SUMMARY OF THE INVENTION

Major improvements embodied in the new version APC described herein are to improve the appearance of the APC system when it is installed on a recovery boiler. This has been achieved by reducing the number of cleaning rods that project from the windbox, and by simplifying the indexing mechanism.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
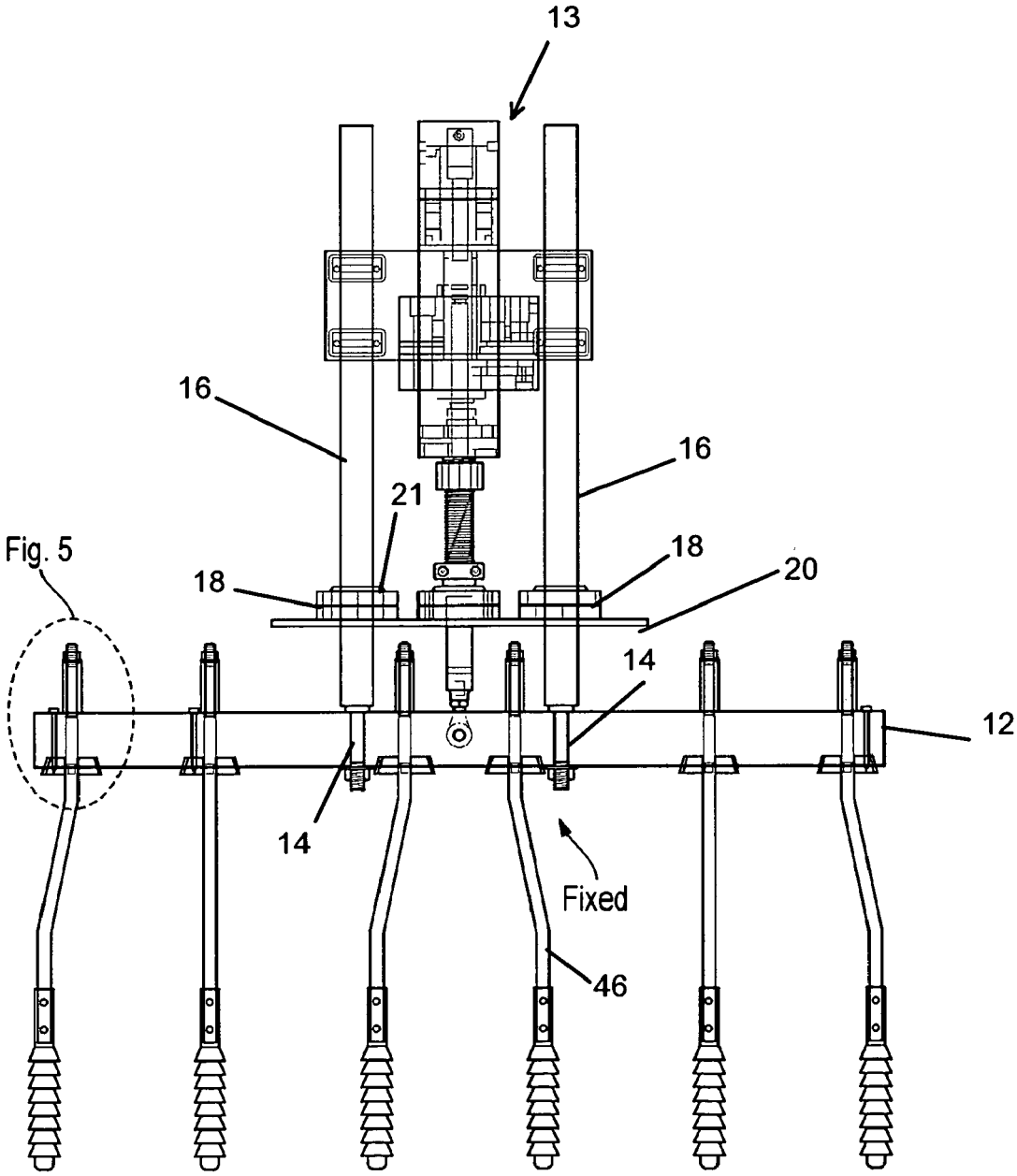
FIG. 1 is a top view of an apparatus according to the invention.
Figure 2:
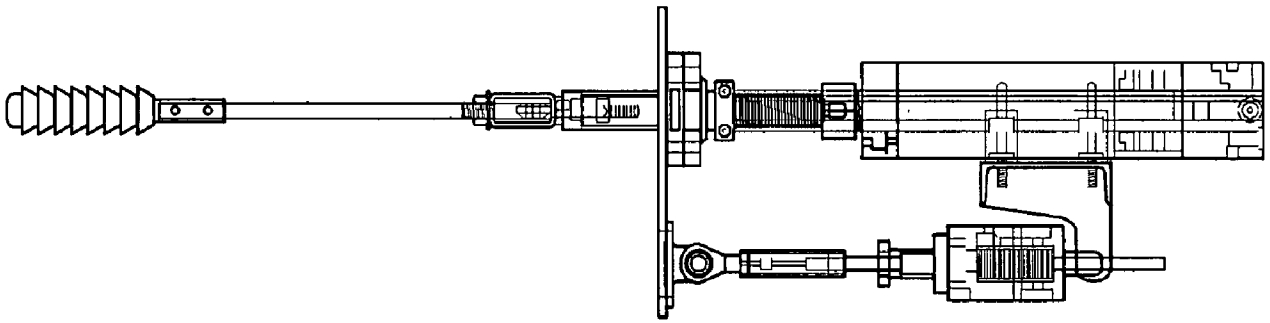
FIG. 2 is a side view thereof.
Figure 3:
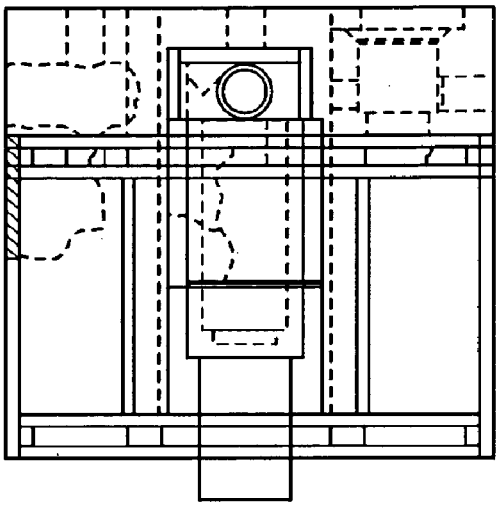
FIG. 3 is view of the hydraulic pump that attaches to the rear of the air cylinder linear actuator.
Figure 4:
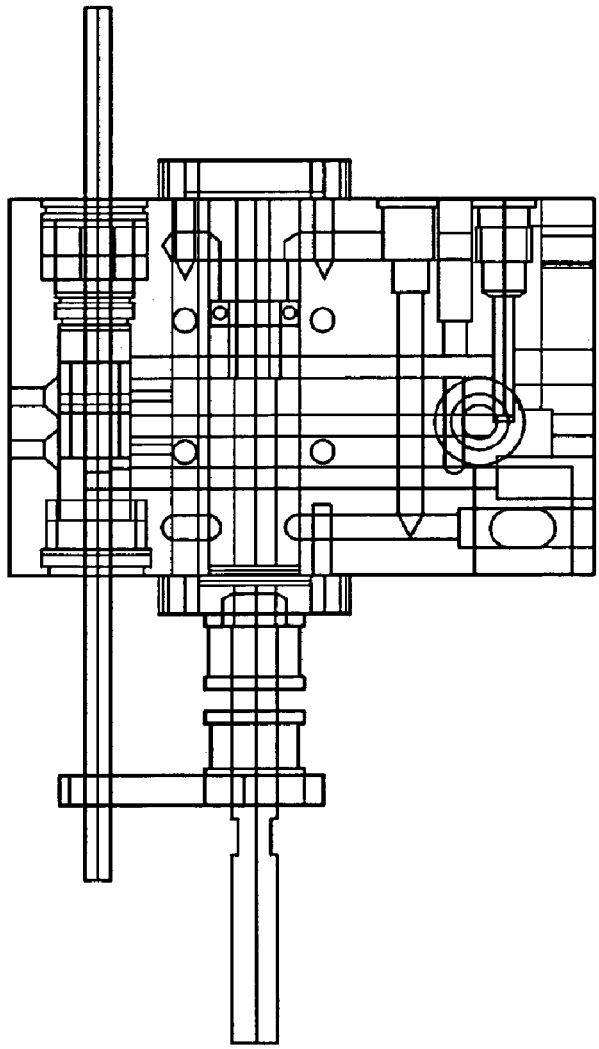
FIG. 4 is a view of the linear actuator.

To reduce the size of the equipment as installed on a recovery boiler, the new version APC terminates the cleaning rods inside the windbox. Each rod is attached to a single horizontal bar 12 (the "extension bar") also residing inside the windbox. The extension bar is in turn attached to the external drive mechanism 13 via two bearing rods 14 (the "fulcrum rods"). The fulcrum rods are slideably engaged in fulcrum tubes 16 that extend into and out of the windbox via a spherical fulcrum housing 18 supporting each fulcrum tube. The fulcrum housings are bolted to a faceplate 20 that removeably attaches the APC to the boiler via a mounting frame. The spherical fulcrum housings engage semi-spherical balls 21 through which the fulcrum tubes are mounted. This arrangement seals the windbox against air leakage and provides a means to pivot the fulcrum tubes and subsequently the cleaning rods and tips. The two fulcrum rods are sized to withstand the forces of the unit in operation that previously were absorbed by the individual cleaning rods and engage the fulcrum tubes via generously sized replaceable bushings. With the cleaning rods and extension bar now located inside the windbox, the width of the APC outside the windbox is reduced and constant regardless of the number of ports cleaned by each unit. For example, a current version APC cleaning five ports with 12 inch port spacing will be about 50 inches wide. The new version APC, also cleaning five ports will be less than 15 inches wide outside the windbox.

A second benefit of the new design is that the linear cleaning motion is completely contained within the fulcrum tubes; therefore the external motion of the APC is reduced to the periodic angular displacement of the unit about the spherical fulcrum housings. The angular displacement occurs as the unit indexes the cleaning tip to a new location after each cleaning stroke.

A third benefit of the new design is the replacement of the mechanical indexing drive with an air/oil mechanism. The new mechanism greatly increases the indexing force available; creates a consistent indexing force in all tip positions; indexes the tips when they are well clear of the port; and eliminates all of the external mechanism required to drive the indexing. The new indexing mechanism consists of two main parts: A hydraulic pump attached to the rear of the air cylinder (the linear actuator used to translate the cleaning rods), and a hydraulic manifold incorporating a hydraulic cylinder and valves. The pump consists of a housing with a cylindrical bore containing a spring-loaded piston. The housing is sized to match the dimensions of the attached air cylinder. A portion of the material surrounding the perimeter of the housing is removed and this portion is covered by a piece of stainless steel tubing to form a fluid reservoir. The tubing is the same material used for the air cylinder barrels. The assembled pump is attached to the tail end (opposite the rod end) of the air cylinder with the pump piston extending through a hole in the tail of the air cylinder, such that when the air cylinder retracts (tips withdrawn from the air ports) the air cylinder piston contacts and depresses the pump piston forcing a charge of hydraulic fluid to the manifold. When the air cylinder extends (tips into the ports), the air cylinder piston disengages the pump piston, allowing the pump piston to retract by the force of the internal spring. As the pump piston retracts, a charge of hydraulic fluid is drawn into the pump cylinder from the reservoir via a check valve. The pump is then ready to send a next charge of fluid to the manifold. With each stroke of the air cylinder and pump piston, a charge of fluid is sent to the hydraulic cylinder housed in the manifold. Each shot of fluid causes the piston in the hydraulic cylinder to be displaced incrementally. As the hydraulic piston is incrementally displaced, the hydraulic cylinder rod extends (or retracts) incrementally which causes the APC to index. A series of valves incorporated into the manifold reverses the indexing direction and otherwise controls the indexing motion. As the hydraulic piston moves, fluid is displaced from the low-pressure side and forced back to the reservoir surrounding the pump. In this manner the fluid is constantly circulated between the pump and the manifold. The pump is connected to the manifold by two high-pressure flexible hoses. The two previously described fulcrum tubes are held in rigid alignment by a cross brace. The manifold is suspended between the cross brace and the APC faceplate, with the hydraulic cylinder rod pivotally attached to the faceplate, and the manifold pivotally attached to the cross brace.

While the above illustrated embodiment employs an interaction of the air cylinder to depress an indexing pump, an alternate manner of accomplishing the desired result for indexing is to employ a hydraulic rotary actuator, wherein, for example, a vane type pump or rotary piston pump is employed. Further, electrically operated indexing mechanisms may be employed.

Figure 5:
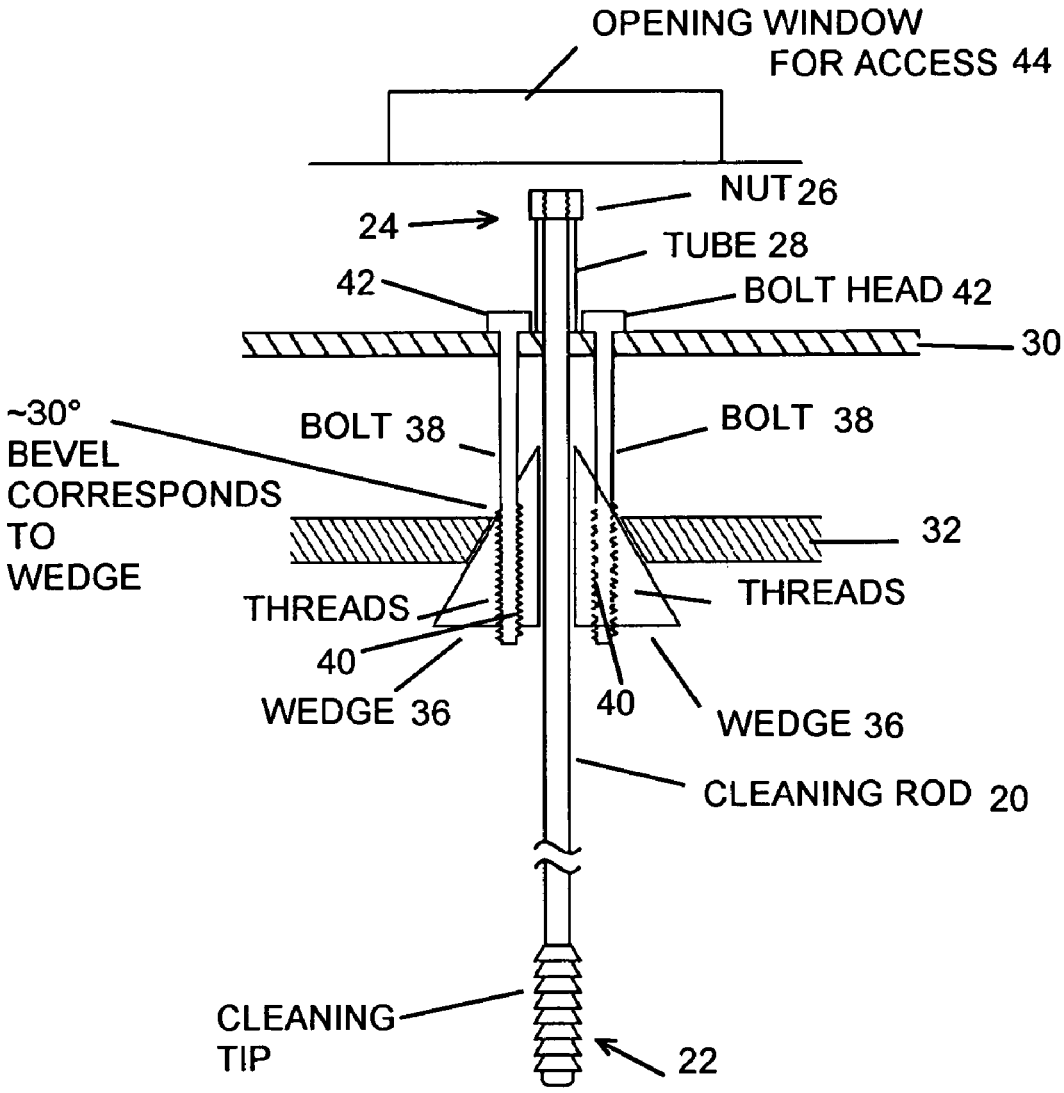
FIG. 5 is a view of an adjustment mechanism to enable adjusting of the cleaning tips from outside the wind box.

FIG. 5 illustrates components to enable adjustment of the cleaning rods, wherein a single cleaning rod 20 is shown as an example. The tip 22 end of the rod extends into the interior of the port, while the distal end 24 of the rod is threaded to receive a nut thereon. A tube 28 is positioned between the nut and the mounting bar outer wall 30. Spaced inwardly from the outer wall is an inner wall 32, which has a beveled opening 34 to receive the cleaning rod therethrough. Corresponding wedge members 36 are mounted on sides of the rod, and the wedges receive bolt members 38 therethrough, via threaded apertures 40 so that the wedges act also as nuts on the bolts. The bolts extend through to the outer wall where the bolt head 42 is accessible. In operation, an opening 44 is provided for access to the various above-described bolt heads and nuts, and the wedges may be loosened by turning the bolt head. In operation, to adjust the position of the cleaning rod (and therefore, the rod tip) to the left or right, the bolt for the wedge on the side to which movement is desired is loosened. The bolt may be tapped upon to free up the wedge member. Then, the bolt for the wedge on the opposite side is turned to tighten up the wedge (that is, to draw the wedge closer to the bolt head) which causes movement of the cleaning rod toward the direction of the loosened wedge. Then, when the rod is moved to the desired position, the loosened wedge bolt is retightened, securing the rod in the new adjusted position. This is desirable to accommodate for thermal expansion, for example.

The cleaning rod positions relative to the actuators can be adjusted horizontally somewhat by providing a slotted engagement. Then, to adjust the positioning of the rods, the mounting may be loosened, and slid within the slots.

In the embodiment of FIG. 1, for example, the cleaning rods are configured with one rod, the $4^{th}$ rod from the left 46 in the view of FIG. 1. This rod is not provided with the wedge adjustment mechanism. However, the remaining rods are provided with the mechanism. In use, the system is mounted so that the fixed rod 46 is positioned relative to the port it corresponds to, and the remaining rods can then be adjusted via the wedge mechanism to accommodate differences.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. An indexing style Automatic Port Cleaner for cleaning furnace combustion air ports comprising:

multiple cleaning tips and rods enclosed substantially in a furnace windbox;

an extension bar enclosed substantially in a furnace windbox to which the cleaning rods are attached with the extension bar carrying the cleaning rods and tips in a translating and indexing motion;

said extension bar being supported by two fulcrum rods in turn supported by two fulcrum tubes and two fulcrum housings, the fulcrum housings being supported by a faceplate and fixed relative to the combustion air ports;

the fulcrum rods adapted to translate relative to the fulcrum tubes while the fulcrum tubes rotate relative to the fulcrum housings;

a linear actuator disposed to create a reciprocating translating motion of the fulcrum rods, extension bar, cleaning rods, and cleaning tips;

an indexer disposed to create rotation of the fulcrum tubes, fulcrum rods, extension bar, cleaning rods, and cleaning tips, in a reciprocating fashion about the fulcrum housings.

2. The apparatus of claim 1 further comprising utilizing a hydraulic indexer.

3. The apparatus of claim 2 utilizing a hydraulic pump actuated by a reciprocating linear actuator.

4. The apparatus of claim 3 in which the linear actuator is a pneumatic cylinder.

5. The apparatus of claim 3 in which the hydraulic pump is removeably attached to the linear actuator.

6. The apparatus of claim 3 in which at least one valve is incorporated into the pump.

7. The apparatus of claim 3 in which a fluid reservoir is incorporated into the pump.

8. The apparatus according to claim 3, wherein said reciprocating linear actuator is a separate linear actuator from said linear actuator disposed to create a translating motion of the fulcrum rods, extension bar, cleaning rods and cleaning tips.

9. The apparatus of claim 2 further comprising incorporating a hydraulic cylinder disposed to create the indexing motion.

10. The apparatus of claim 9 in which the hydraulic cylinder reciprocates incrementally.

11. The apparatus of claim 9 in which a a reverser is included to automatically reverse the direction of the hydraulic cylinder.

12. The apparatus of claim 11 in which the reverser includes a spool valve actuated by the hydraulic cylinder.

13. The apparatus of claim 11 in which the reverser incorporates a pressure switch.

14. The apparatus of claim 11 in which the reverser is incorporated into the hydraulic cylinder.

15. The apparatus of claim 9 incorporating a controller to control the motion of the hydraulic cylinder.

16. The apparatus of claim 15 in which the controller is a needle valve.

17. The apparatus of claim 15 in which the controller is a fixed orifice.

18. The apparatus of claim 2, comprising a hydraulic rotary actuator disposed to create the indexing motion.

19. The apparatus of claim 18 incorporating a controller to control the motion of the hydraulic cylinder.

20. The apparatus of claim 19 in which the controller is a needle valve.

21. The apparatus of claim 20 in which the controller is a fixed orifice.

22. The apparatus of claim 2 utilizing a manifold to contain and direct the passage of hydraulic fluid.

23. The apparatus of claim 22 in which a hydraulic cylinder is incorporated into the manifold.

24. The apparatus of claim 22 in which a system of valves is incorporated into the manifold.

25. The apparatus of claim 2 incorporating a disengager to disengage the indexing means to allow free rotation of the apparatus.

26. The apparatus of claim 25 in which a by-pass valve, when opened, allows hydraulic fluid to freely flow from one end of a hydraulic cylinder to the other end.

27. The apparatus of claim 1 being adapted to enable removal of the assembled faceplate, fulcrum tubes, fulcrum housings, linear actuator and indexing means from the windbox, leaving the assembled cleaning tips, rods, extension bar and fulcrum rods in place substantially inside the windbox.

28. The apparatus of claim 27 incorporating a disconnector between the linear actuator and the extension bar to enable the removal of the assembled faceplate, fulcrum tubes, fulcrum housings, linear actuator and indexer from the windbox.

29. The apparatus of claim 1 adapted to enable removal of the linear actuator from the apparatus without requiring removal of the apparatus from the windbox.

30. The apparatus of claim 29 in which a cylinder extension rod provides the ability for removal.

31. The apparatus of claim 1 in which an adjuster is incorporated to compensate for wear of the cleaning tips.

32. The apparatus of claim 31 in which the linear actuator is moved relative to the faceplate and fulcrum housings to reposition the cleaning tips relative to the combustion air ports.

33. The apparatus of claim 1 incorporating an adjuster to enable adjustment of the spacing of the cleaning tips.

34. The apparatus of claim 33, wherein said adjuster comprises providing slideable mounting engagement of said cleaning rods relative to the extension bar.

35. The apparatus of claim 33 in which the cleaning rods are forced to bend relative to the extension bar.

36. The apparatus of claim 33 incorporating an adjuster to adjust the spacing of the cleaning tips while the apparatus is mounted on the windbox.

37. The apparatus of claim 1 in which the linear actuator is a pneumatic cylinder disposed to create a reciprocating translating motion of the cleaning rods and tips;

the pneumatic cylinder also disposed to periodically actuate a hydraulic pump;

the hydraulic pump incorporating a pump piston, at least one valve, at least one piston seal, a fluid reservoir, a piston return spring, and connection, filling and bleeding ports; the hydraulic pump forcing a charge of hydraulic fluid to a manifold with each stroke of the pneumatic cylinder;

the manifold incorporating a system of valves and a hydraulic cylinder; the valve system controlling the motion and direction of the hydraulic cylinder;

the hydraulic cylinder reversibly extending and retracting incrementally relative to the volume of fluid displaced by the hydraulic pump;

the extension and retraction of the hydraulic cylinder disposed to create incremental rotation of the tips, rods, extension bar, fulcrum rods and fulcrum tubes in order to index the cleaning tips relative to the combustion air ports.

38. The apparatus according to claim 1, comprising wedge mounting members for mounting said cleaning rods for enabling positional adjustment thereof.

* * * * *